US008307944B2

(12) United States Patent
Reinheimer et al.

(10) Patent No.: US 8,307,944 B2
(45) Date of Patent: Nov. 13, 2012

(54) MUFFLER

(75) Inventors: Thomas Reinheimer, Saarbrücken (DE); Michael Schmidt, Friedrichstal (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 13/242,142

(22) Filed: Sep. 23, 2011

(65) Prior Publication Data

US 2012/0132478 A1 May 31, 2012

(30) Foreign Application Priority Data

Nov. 26, 2010 (DE) ..... 10 2010 062 049

(51) Int. Cl.

| | |
|---|---|
| ***F01N 1/00*** | (2006.01) |
| ***F01N 1/08*** | (2006.01) |
| ***F01N 1/24*** | (2006.01) |
| ***F01N 3/02*** | (2006.01) |
| ***F01N 3/10*** | (2006.01) |
| ***F01N 5/00*** | (2006.01) |
| ***F01N 13/08*** | (2010.01) |
| ***F01N 13/10*** | (2010.01) |
| ***F01N 13/18*** | (2010.01) |

(52) U.S. Cl. ..... 181/212; 60/299; 60/302; 181/227; 181/228; 181/231; 181/240; 181/255; 181/256; 181/258; 181/264; 181/268; 181/269; 181/272; 181/282

(58) Field of Classification Search ..... 181/212, 181/227, 228, 231, 240, 269, 272, 282; 60/299, 60/302, 308

See application file for complete search history.

(56) References Cited

U.S. PATENT DOCUMENTS

| | | | | |
|---|---|---|---|---|
| 3,381,774 | A * | 5/1968 | Stade et al. | 181/272 |
| 3,854,888 | A * | 12/1974 | Frietzsche et al. | 422/171 |
| 4,252,212 | A * | 2/1981 | Meier | 181/248 |
| 4,283,368 | A * | 8/1981 | Harada et al. | 422/181 |
| 5,036,585 | A * | 8/1991 | Schweinfurth | 29/890.08 |
| 5,338,903 | A * | 8/1994 | Winberg | 181/231 |
| 5,732,555 | A * | 3/1998 | Gracyalny et al. | 60/299 |
| 5,746,986 | A * | 5/1998 | Pollock et al. | 422/177 |
| 5,959,263 | A * | 9/1999 | Foltz, Jr. | 181/254 |
| 6,158,214 | A * | 12/2000 | Kempka et al. | 60/302 |
| 6,241,044 | B1 * | 6/2001 | Nishiyama et al. | 181/272 |
| 6,250,422 | B1 * | 6/2001 | Goplen et al. | 181/272 |
| 6,393,835 | B1 * | 5/2002 | Stoll et al. | 60/299 |
| 6,702,062 | B2 * | 3/2004 | Kusabiraki et al. | 181/240 |
| 6,789,644 | B2 * | 9/2004 | Mukaida | 181/272 |
| 7,162,868 | B2 * | 1/2007 | Funakoshi | 60/323 |
| 7,296,657 | B2 * | 11/2007 | Ohno et al. | 181/272 |
| 7,434,656 | B2 * | 10/2008 | Yasuda et al. | 181/227 |
| 7,537,083 | B2 * | 5/2009 | Frederiksen | 181/231 |

(Continued)

*Primary Examiner* — David Warren
*Assistant Examiner* — Christina Russell
(74) *Attorney, Agent, or Firm* — McGlew and Tuttle, P.C.

(57) ABSTRACT

A muffler (1) for an exhaust system (2) of an internal combustion engine, especially of a motor vehicle, with a muffler housing (3), which encloses a housing interior space (5), and with at least one exhaust gas-carrying hollow body (4) with two half shells in a half shell construction. The hollow body is arranged in the housing interior space (5). The two half shells (14, 15) of the hollow body (4) are fastened to one another in the area of a separating plane (16). The assembly of the muffler (1) or of the hollow body (4) can be simplified if the two half shells (14, 15) are fastened to one another by fastening elements (17, 18), which are formed directly on the half shells (14, 15).

17 Claims, 4 Drawing Sheets

U.S. PATENT DOCUMENTS

| | | | | |
|---|---|---|---|---|
| 7,779,963 | B2 * | 8/2010 | Muto | 181/252 |
| 7,896,127 | B2 * | 3/2011 | Sato et al. | 181/240 |
| 8,083,026 | B1 * | 12/2011 | Butler | 181/264 |
| 2002/0066619 | A1 * | 6/2002 | Collmer et al. | 181/251 |
| 2009/0038879 | A1 * | 2/2009 | Sato et al. | 181/228 |
| 2010/0146955 | A1 * | 6/2010 | Tuch | 60/324 |

* cited by examiner

MUFFLER

CROSS REFERENCE TO RELATED APPLICATIONS

This application claims the benefit of priority under 35 U.S.C. §119 of German Patent Application DE 10 2010 062 049.1 filed Nov. 26, 2010, the entire contents of which are incorporated herein by reference.

FIELD OF THE INVENTION

The present invention pertains to a muffler for an exhaust system of an internal combustion engine, especially of a motor vehicle.

BACKGROUND OF THE INVENTION

A muffler (also known as a silencer) usually comprises a muffler housing, which encloses a housing interior space, wherein at least one exhaust gas-carrying hollow body is arranged in the housing interior space, for example, in the form of a tube, especially in the form of a deflecting tube or in the form of an X tube or Y tube.

Various possibilities are available for manufacturing such hollow bodies. They may be, for example, deep-drawn or manufactured in winding construction. A half shell construction is possible as well, in which two half shells of the hollow body are attached to one another in the area of a separating plane.

SUMMARY OF THE INVENTION

An object of the present invention is to provide a muffler in an improved embodiment, which is characterized especially by an especially inexpensive manufacturability.

According to the invention, a muffler is provided for an exhaust system of an internal combustion engine, especially of a motor vehicle. The muffler comprises a muffler housing, which encloses a housing interior space. At least one exhaust gas-carrying hollow body in a half shell construction is arranged in the housing interior space. The two half shells of the hollow body are fastened to one another in an area of a separating plane, wherein the two half shells are fastened to one another by fastening elements which are formed directly on the half shells.

The present invention is based on the general idea of fixing the two half shells directly mechanically to one another in a hollow body of a half shell construction, without additional fastening means having to be used for this. The present invention proposes for this to form fastening areas or fastening elements, which cooperate with one another for the mechanical connection of the two half shells, directly, i.e., integrally on the half shells. These fastening areas or fastening elements may cooperate in the manner of a plug-type connection or clip connection or locking connection or by a combination of the above connection techniques in order to fix the two half shells to one another. This leads to an especially simple handling for the assembly of the hollow body, because all the needed fastening elements are formed directly on the half shells, as a result of which additional, separate fastening elements may be eliminated. In particular, a complicated screw connection or a complicated welded connection can be eliminated. It is clear that the possibility of using additional, separate fastening elements, for example, clamps or screws or weld points or weld seams to complement the assembly of the hollow body in addition to the fastening elements formed integrally on the half shells shall not, in principle, be ruled out. However, the special advantage of the present invention being presented here is seen in the fact that the fixing of the two half shells to one another can be brought about exclusively by the fastening elements already present directly on the half shells.

Especially advantageous is an embodiment in which the two half shells have an outwardly projecting collar each in the area of the separating plane on sides that are spaced apart from each other, wherein the fastening elements are formed on said collar and wherein the two half shells are in contact with one another at these collars and are fastened to one another. The collars define the relative position between the two half shells and are especially suitable for arranging the fastening elements, because they are located outside a hollow space enclosed by the hollow body and correspondingly do not compromise the exhaust gas ducting in the hollow body.

According to an advantageous variant, at least one of the collars of one half shell may have a bracket located at a spaced location from the separating plane as a fastening element, which extends in parallel to the separating plane in the longitudinal direction of the respective collar and extends over the corresponding collar of the other half shell in a collar section used as a complementary fastening element. The bracket forms a positive-locking connection, which securely fixes the two half shells to each other, with the corresponding collar section.

Preferred is an embodiment in which the corresponding collar of the other half shell has at least one interruption, through which the bracket can be passed during the assembly of the hollow body at right angles to the separating plane, i.e., at right angles to the longitudinal direction of the respective collar. A kind of plug-in/pushing coupling is achieved as a result, in which the two half shells must be moved in a first relative position in relation to one another at right angles to the separating plane in order for the respective bracket to be able to pass through the corresponding interruption. This first relative motion or plug-in motion now follows at right angles to the separating plane. As soon as the two half shells are in contact with one another via their collars in the separating plane, a second relative motion takes place in the longitudinal direction of the respective collar, which motion is within the separating plane, in order for the respective bracket to be able to reach behind the corresponding collar section. This second relative motion or pushing motion brings the two half shells into another relative position, which corresponds to the assembled final state.

According to another embodiment, the respective bracket may extend, relative to the longitudinal direction of the respective collar, over a beginning area or end area of the corresponding collar of the other half shell. Depending on the dimension of the collar, no interruption of the collar, through which the bracket can be passed, is thus necessary, but a collar that is shortened compared to the collar having the bracket can rather also make available sufficient free space at the beginning area or at the end area, through which free space the respective bracket can be moved past at the collar section to be reached over during the plug-in operation in order to then extend over it during the pushing operation.

Corresponding to another embodiment, the corresponding collar of the other half shell may have in the collar section extended over by the bracket at least one projection at right angles to the separating plane in the direction of the bracket. A clamping action, which increases the friction between the bracket and the collar section that is reached over, can be produced or intensified by means of this projection. The fixing of the two half shells to one another can be improved hereby.

The projection may be formed integrally, for example, by a stamping operation on the respective collar, which simplifies the manufacture of the projection or of the half shell.

It is especially advantageous in this case if the respective bracket has a locking contour, which locks with the respective projection. A positive-locking connection is achieved due to the locking between the bracket and the projection in the pushing direction as well, i.e., in the longitudinal direction of the brackets, which is in the separating plane, as a result of which the final mounted position between the two half shells is secured.

The respective bracket may be opened from the respective collar in another advantageous embodiment. In other words, the respective bracket is formed by cutting free or stamping free and opening directly or integrally by a section of the bracket, which simplifies the manufacture of the respective half shell.

Especially advantageous is an embodiment in which a plurality of brackets are arranged on the same collar at spaced locations from one another in the longitudinal direction of the collar. A plurality of fastening points or fastening sites can be obtained hereby, which are located at spaced locations from one another in the longitudinal direction of the collar along the collars, which are in contact with one another. This leads to an especially effective fixing of the two half shells.

According to another advantageous embodiment, each collar of one half shell may have at least one bracket. This causes each collar of the other half shell to have at least one collar section over which the respective bracket can extend. The assembly of the hollow body becomes simpler due to this mode of construction, because the risk of confusing the half shells is reduced. One half shell has all the brackets, while the other half shell has no bracket. Both the manual and mechanical assembly of the two half shells is simplified hereby.

Corresponding to another embodiment, each collar of one half shell may have at least two brackets, while the collars of the other half shell have at least one interruption each. While the respective first bracket will thus cooperate with the respective interruption, the respective second bracket can cooperate with another interruption or with a beginning area or end area of the respective bracket.

Corresponding to another embodiment, the hollow body may have at least one exhaust gas inlet and at least one exhaust gas outlet, which are each divided by the separating plane, preferably in half. The exhaust gas inlet and exhaust gas outlet are preferably located in a plane each that extends at right angles to the separating plane. An edge section is preferably formed on the respective half shell for the exhaust gas inlet and for the exhaust gas outlet, respectively, which edge section extends over 180° of the exhaust gas inlet and of the exhaust gas outlet in the circumferential direction.

The hollow body may be preferably a straight tube or a bent deflecting tube or a Y tube. While simple tubes have exactly one inlet and exactly one outlet, a Y tube has either two inlets and one outlet or one inlet and two outlets. An X-tube may, in principle, also form such a hollow body.

At least one of the half shells may be provided with a perforation, through which the respective hollow body within the muffler can be passed, for example, through an absorption chamber or through a resonance chamber or through an expansion chamber in order to produce a certain muffling effect.

It is apparent that the above-mentioned features, which will also be explained below, are applicable not only in the particular combination indicated but in other combinations or alone as well, without going beyond the scope of the present invention.

Preferred exemplary embodiments of the present invention are shown in the drawings and will be explained in more detail in the following description, where identical reference numbers designate identical or similar or functionally equivalent components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
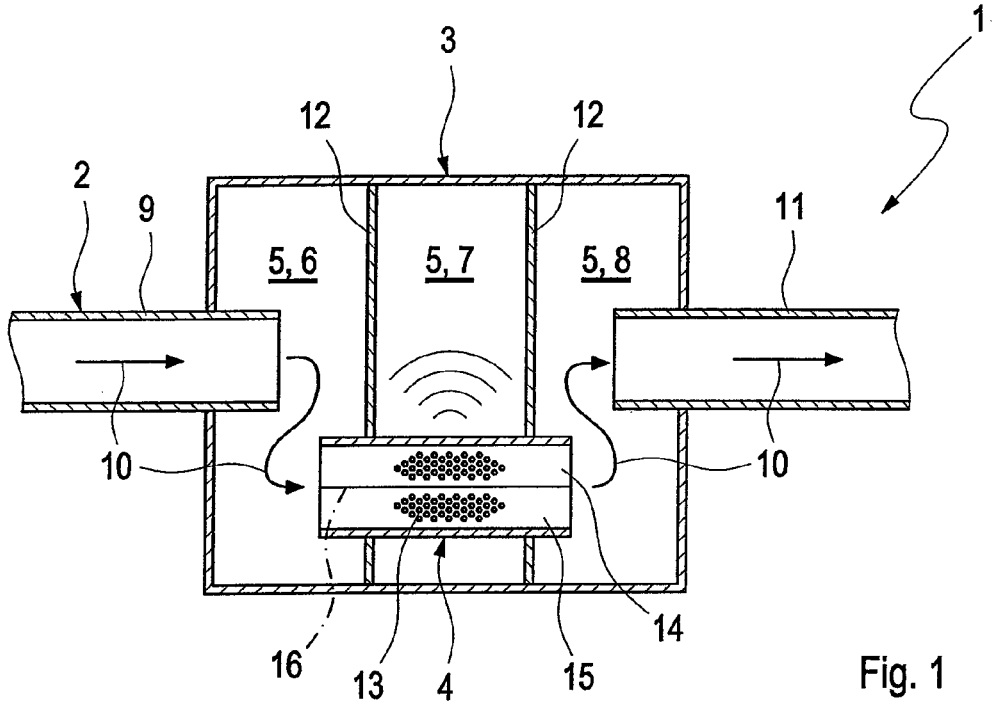
FIG. 1 is a highly simplified general view of a muffler with a hollow body according to the invention.

Referring to the drawings in particular, corresponding to FIG. 1, a muffler 1 of an exhaust system 2, which is shown in the area of the muffler 1 only and is used to remove exhaust gases of an internal combustion engine, not being shown here, is arranged, together with the exhaust system 2, in a motor vehicle and has a muffler housing 3 and at least one hollow body 4. The muffler housing 3 encloses a housing interior space 5, which may be divided, for example, into a plurality of chambers 6, 7, 8. Hollow body 4 is arranged in the housing interior space 5 and is used to guide the exhaust gas. As an example, and without limitation of the general nature, an inlet tube 9 may be connected to the muffler housing 3, where exhaust gas enters through the first chamber 6 of the housing interior space 5. The first chamber acts as an inlet chamber or deflecting chamber, corresponding to arrows 10. The exhaust gas enters, through the hollow body 4, the third chamber 8 of the housing interior space 5, which third chamber acts as a discharge chamber or deflection chamber, from which the exhaust gas is removed via an outlet tube 11. Hollow body 4 is led, for example, through the second chamber 7 of the housing interior space 5, which chamber acts as an absorption chamber and is separated from the other two chambers 6, 8 by partitions 12. Hollow body 4 may be made permeable to airborne sound in the area of the second chamber 7, for example, by means of perforations 13.

Hollow body 4 is manufactured as a half shell construction, so that it has two half shells 14, 15, which are in contact with one another and fastened to one another in the area of a separating plane 16.

Figure 2:
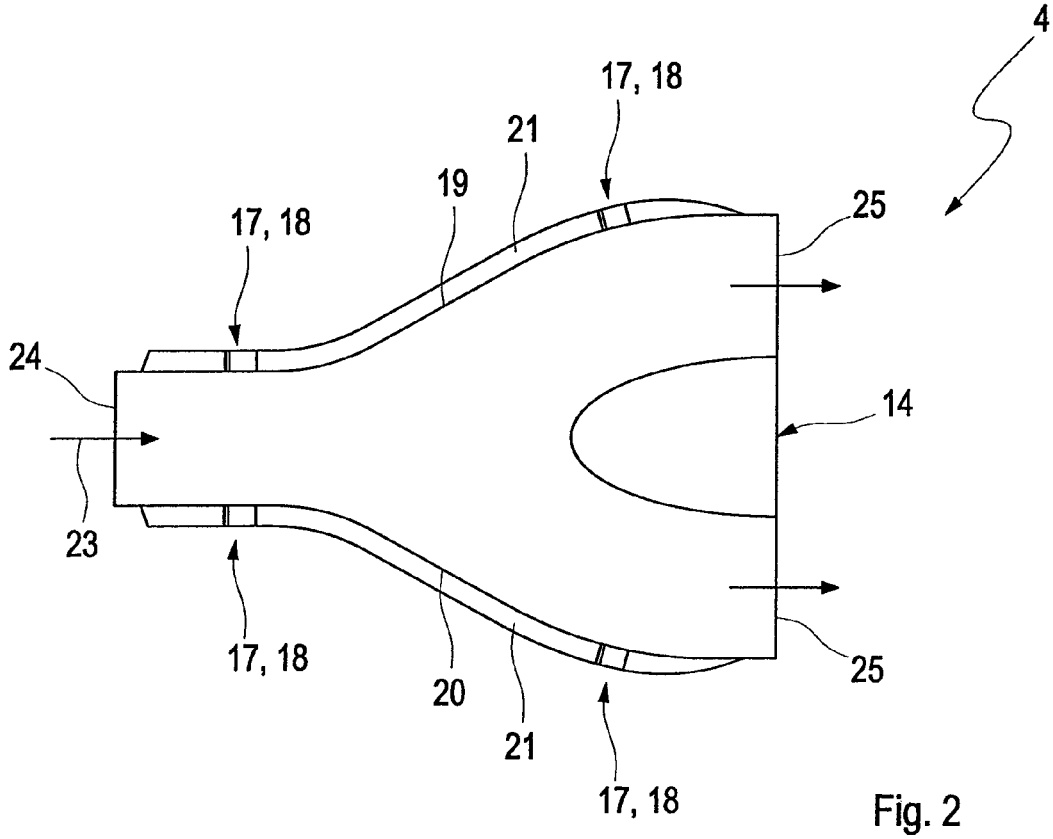
FIG. 2 is a simplified top view of a hollow body designed as a Y tube.
Figure 3:
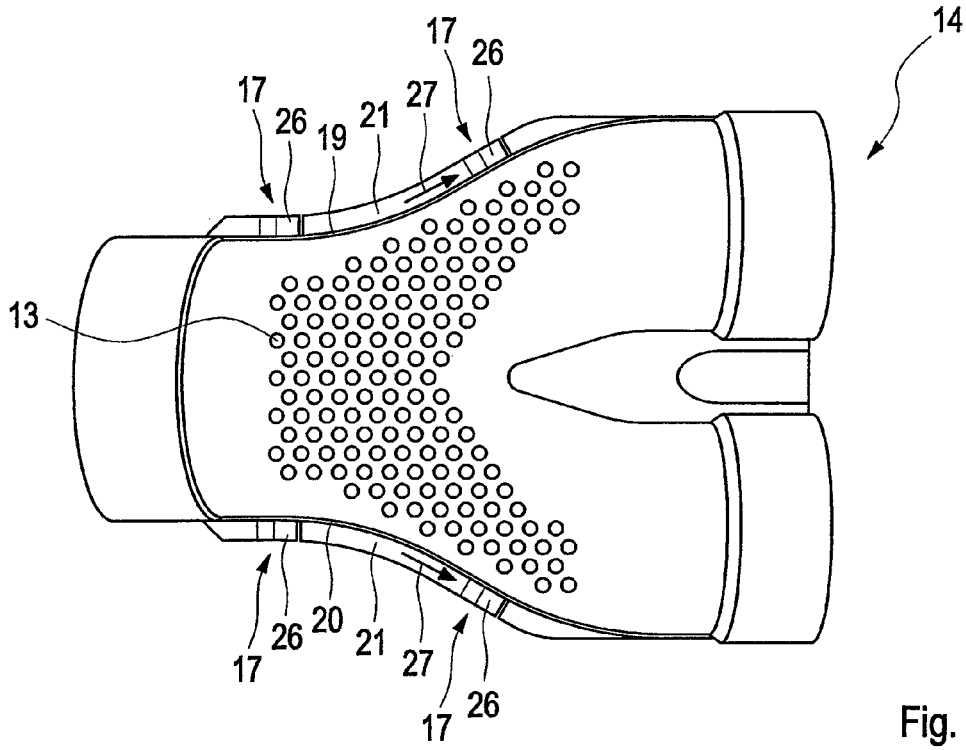
FIG. 3 is a top view of a first half shell of the hollow body.
Figure 4:
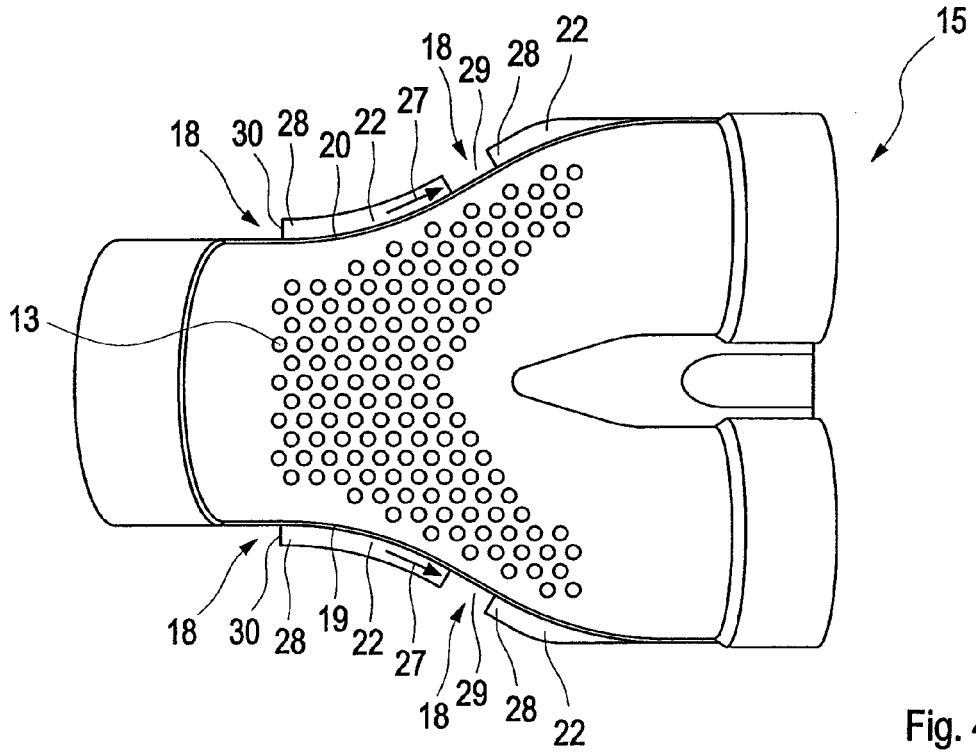
FIG. 4 is a top view of a second half shell of the hollow body.

Corresponding to FIGS. 2 through 4, hollow body 4 may be, for example, a Y tube. As an alternative, it may also be an X tube. As an alternative, the hollow body 4 may also be a bent deflecting tube or an unbent or straight tube.

In addition, the perforations 13 provided in reference to FIG. 1 can be recognized in FIGS. 3 and 4.

Corresponding to FIGS. 2 through 8, the half shells 14, 15 are fastened to one another by means of fastening elements 17, 18, these fastening elements 17, 18 being formed directly at the half shells 14, 15. In particular, the fastening elements 17, 18 are formed integrally on the respective half shell 14, 15. The two half shells 14, 15 are preferably fastened to one another exclusively via these fastening elements 17, 18 formed directly on them. The half shells 14, 15 are, for example, shaped sheet metal parts, which are manufactured from one piece of sheet metal with the respective fastening elements 17, 18.

To prepare these integrated fastening elements 17, 18, each half shell 14, 15 has, in the area of the separating plane 16 on mutually distant sides 19, 20, an outwardly projecting collar 21 and 22 each, namely, a first collar 21 at the one or first half shell 14 and a second collar 22 at the other or second half shell 15. The fastening elements 17, 18 are formed at these collars 21, 22. These sides 19, 20 are preferably spaced apart from each other at right angles to a direction of flow 23 in the hollow body 4, which direction is indicated by an arrow. Hollow body 4 thus has at least one exhaust gas inlet 24 and at least one exhaust gas outlet 25. In the example shown of the hollow body 4 designed as a Y tube, a single inlet opening 24 and exactly two outlet openings 25 are obtained based on the direction of flow 23 assumed here. An opposite direction of flow is, in principle, conceivable as well. Furthermore, both the inlet opening 24 and the two outlet openings 25 are arranged in the example in planes that extend at right angles to the separating plane 16. The separating plane 16 preferably divides the respective exhaust gas inlet 24 and the respective exhaust gas outlet 25 in half.

Figure 6A:
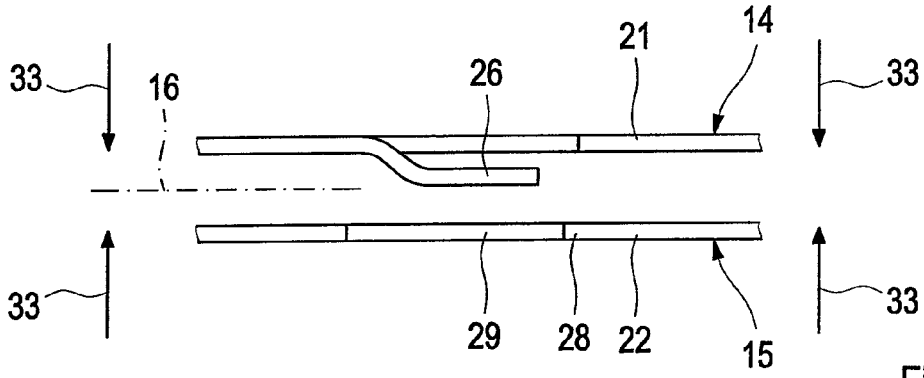
FIG. 6*a* is a side view of the hollow body during assembly, in one of different states of assembly.
Figure 6B:
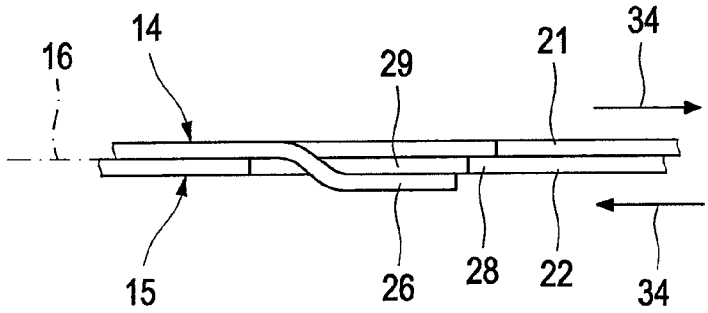
FIG. 6*b* is a side view of the hollow body during assembly, in another of different states of assembly.
Figure 6C:
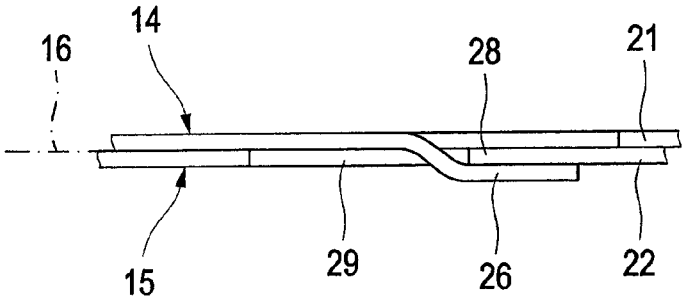
FIG. 6*c* is a side view of the hollow body during assembly, in another of different states of assembly.
Figure 7:
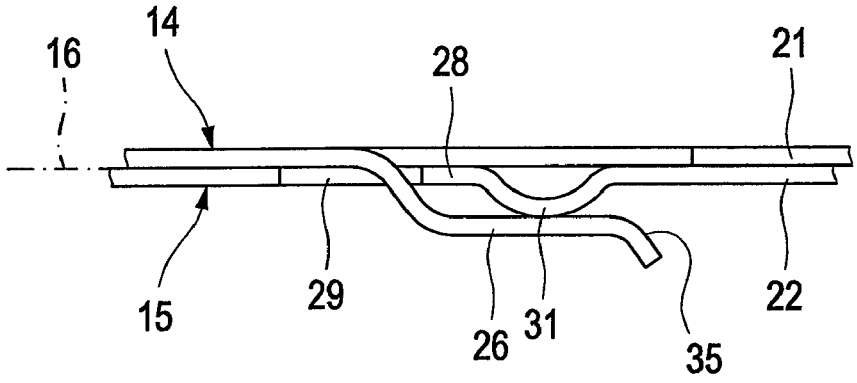
FIG. 7 is a side view of the hollow body in the area of a bracket for another embodiment.
Figure 8:
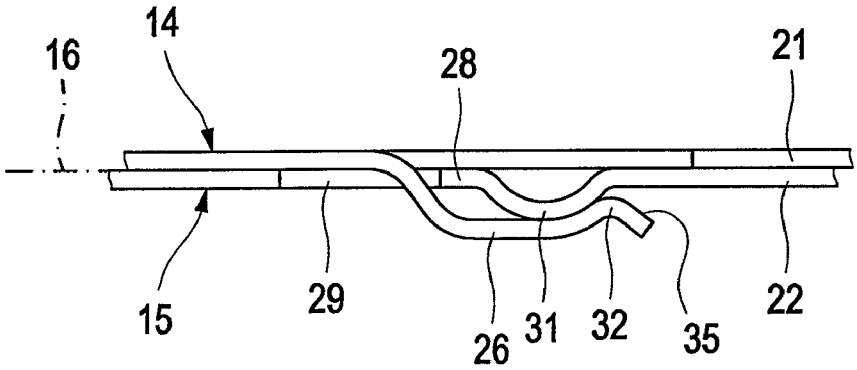
FIG. 8 is a side view of the hollow body in the area of a bracket for another embodiment.

The two half shells 14, 15 are in contact with each other at the aforementioned collars 21, 22, which can be seen especially in FIG. 6 through 8. Furthermore, the half shells 14, 15 are fastened to one another via these collars 21, 22, so that the collars 21, 22 are fastened to one another.

Preferred embodiments for the fastening elements 17, 18 will be explained in more detail based on FIGS. 3 through 8. It is clear that it is also possible, in principle, to use other fastening elements 17, 18, which make possible the mechanical fixing of the two half shells 14, 15 to one another and make do without additional, further fastening means, for example, clamps, screws or welded connections.

Corresponding to FIGS. 3 through 8, the two collars 21 of the first half shell 14 have at least one bracket 26 each. In the preferred example being shown, the respective collar 21 has two such brackets 26, so that the first half shell 14 has four brackets 26 in the example. The respective bracket 26 represents the respective fastening element 17 of the first half shell 14. The respective bracket 26 extends in parallel to the separating plane 16 and at a spaced location therefrom in the longitudinal direction of the respective collar 21, which said direction is indicated by arrows 27.

According to FIG. 4, the second half shell 15 has, at its two collars 22, a collar section 28 for each bracket 26 of the first half shell 14, wherein said collar section represents a second fastening element 18 complementary to bracket 26 or to the first fastening element 17. In the assembled state, which can be seen in FIGS. 6*c*, 7 and 8, the respective bracket 26 extends over the corresponding collar section 28.

In order for the respective bracket 26 to be able to extend over the corresponding collar section 28, the respective collar 22 of the second half shell 15 has, e.g., at least one interruption 29, which interrupts the respective collar 22 in the longitudinal direction 27 thereof and which is dimensioned such that the respective bracket 26 can be passed through the respective interruption 29 at right angles to the separating plane 16 and hence at right angles to the longitudinal direction 27 of the respective collar 21 or 22. The collars 22 of the embodiment shown in FIG. 4 show only one such interruption 29 each, which is adjoined by one of the collar sections 28 each. The other two collar sections 28 are formed, by contrast, at a beginning area 30 of the respective collar 22 or, depending on the orientation of the longitudinal direction 27, at an end area of the respective collar 22. The corresponding bracket 26 can thus likewise be moved past the corresponding collar section 28 at right angles to the separating plane 16.

FIGS. 2 through 4 thus show embodiments in which a plurality of brackets 26 are arranged at the same collar 21 at spaced locations from one another in the longitudinal direction 27 of collar 21. Exactly two brackets 26 per collar 21 are located at spaced locations from one another in the longitudinal direction 27 of the collar in the example. Furthermore, according to FIGS. 3 and 4, the brackets 26 are formed exclusively on the first half shell 16, while the collar sections 28 associated with the brackets 26 are formed here exclusively on the second half shell 15.

The interruptions 29 can be prepared simply by punching out or cutting out corresponding sections of the respective collar 22. The brackets 26 can be prepared, by contrast, for example, by cutting free or punching free longitudinal sections within the respective collar 21 and subsequently opening them, so that the brackets 26 form integral parts of collar 21.

Figure 5:
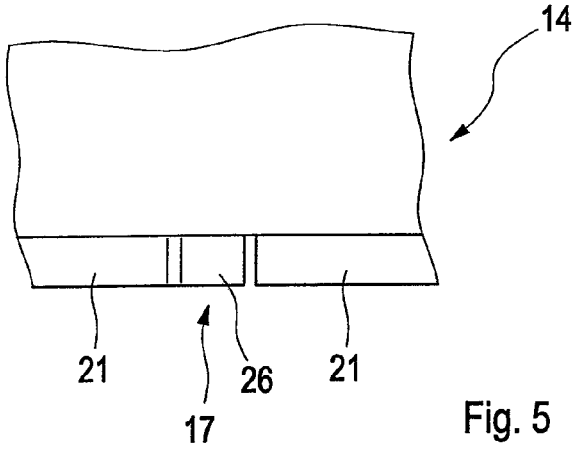
FIG. 5 is a top view of the first half shell in the area of a bracket.

FIG. 5 shows the first half shell 14 in the area of such a bracket 26 cut free.

Corresponding to FIG. 6*c*, the respective bracket 26 may be located at such a spaced location from the separating plane 16 that the corresponding collar section 28 is clamped or clamped in with a prestress oriented at right angles to the separating plane 16. In conjunction with the static friction, a holding force, which secures the half shells 14, 15 mounted on one another in the assembled state, can be produced in this manner in parallel to the separating plane 16.

To increase this securing holding force, provisions may be made according to FIGS. 7 and 8 for providing the respective collar section 28 with at least one projection 31, which projects in the direction of bracket 26 at right angles to the separating plane 16. When projection 31 passes over the collar section 28, bracket 26 is thus displaced in a direction directed away from the separating plane 16, which increases the prestress with which bracket 26 is supported at the collar section 28 or at the projection 31 thereof at right angles to the separating plane 16. Such a projection 31 may be formed integrally, for example, by means of a stamping operation on the respective collar section 28.

According to FIG. 8, the respective bracket 26 may be provided, corresponding to an especially advantageous embodiment, with a locking contour 32, which is shaped such that it can lock with the respective projection 31 as soon as the two half shells 14, 15 reach their mounted positions. For example, the locking contour 32 projects from the corresponding bracket 26 in the direction of the separating plane 16, as a result of which the locking contour 32 can extend behind the respective projection 31. A positive-locking connection is formed hereby in a direction in parallel to the separating plane 16.

In addition or as an alternative to the respective projection 31 and/or to the respective locking contour 32, at least one lead-in bevel 35 may be provided, which is formed in the examples according to FIGS. 7 and 8 at the free end of the bracket 26 in order to simplify the attachment of the respective bracket 26 to the corresponding collar section 28.

The assembly operation, by which the two half shells 14, 15 are fastened to one another in order to form the hollow body 4, will be explained in more detail below on the basis of FIGS. 6*a* through 6*c*.

Corresponding to FIG. 6*a*, the two half shells 14, 15 are at first positioned in relation to one another to set a starting position such that the respective bracket 26 is directed at right angles to the separating plane 16 aligned with the corresponding interruption 29. The two half shells 14, 15 are then moved towards one another corresponding to arrows 33 at right angles to the separating plane 16. The respective bracket 26 can now pass through the corresponding interruption 29, as a result of which the intermediate position shown in FIG. 6*b* is reached. The collars 21, 22 are in contact with one another in the separating plane 16 in this intermediate position. This first adjusting motion according to arrows 33 represents a plug-in operation. This plug-in operation is now followed by a pushing operation, during which the two half shells 14, are moved against each other in parallel to the separating plane 16 corresponding to arrows 34, so that the respective bracket 26 can extend over the corresponding collar section 28. At the end of this pushing motion according to the arrows 34, the relative position according to FIG. 6*c* is present, which represents an end position or a completely assembled state.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a muffler housing, which encloses a housing interior space; and at least one exhaust gas-carrying hollow body comprising two half shells providing a half shell construction, said hollow body being arranged in said housing interior space, wherein:

said two half shells of said hollow body are fastened to one another in an area of a separating plane;

said two half shells are fastened to one another by fastening elements, which are formed directly on the half shells;

in an area of the separating plane on sides spaced apart from each other, said two half shells each have an outwardly projecting collar, on which the fastening elements are formed;

said two half shells are in contact with one another and are fastened to one another at the respective said collar;

at least one said collar has a bracket located at a spaced location from the separating plane, the bracket forming a fastening element, which extends in parallel to the separating plane in a longitudinal direction of the respective said at least one said collar and extends over the corresponding said collar of the other said half shell in a collar section acting as a complementary fastening element; and the corresponding collar of the other half shell has at least one interruption, through which said bracket can be passed, during assembly of the hollow body, at right angles to the longitudinal direction of said collar.

2. A muffler in accordance with claim 1, wherein in regard to the longitudinal direction of the respective collar, the respective bracket reaches over a beginning area or an end area of the corresponding collar of the other half shell.

3. A muffler in accordance with claim 1, wherein the corresponding collar of the other half shell has a projection, projecting in a direction of the bracket, at right angles to the separating plane in a collar section over which said bracket extends.

4. A muffler in accordance with claim 3, wherein said projection is formed by a stamping operation on the respective collar.

5. A muffler in accordance with claim 3, wherein the respective bracket has a locking contour, which is locked with the respective projection.

6. A muffler in accordance with claim 1, wherein the respective bracket is opened from the respective collar.

7. A muffler in accordance with claim 1, wherein a plurality of brackets are arranged on the same collar at spaced locations from one another in the longitudinal direction of the collar.

8. A muffler in accordance with claim 1, wherein each collar of one half shell has at least one bracket.

9. A muffler in accordance with claim 1, wherein said collar of said at least one half shell has another bracket to provide at least two brackets, whereas said collar of the other said half shell has at least another interruption.

10. A muffler internal in accordance with claim 1, wherein the hollow body has at least one exhaust gas inlet and at least one exhaust gas outlet and a separating plane, a region of said exhaust gas inlet being divided from a region of said exhaust gas outlet by said separating plane.

11. A muffler in accordance with claim 1, wherein said hollow body is one of a straight tube, a bent deflecting tube, a Y tube and an X tube.

12. A muffler for an exhaust system of an internal combustion engine, the muffler comprising:

a muffler housing defining a housing interior space; and an exhaust gas-carrying hollow body arranged in said housing interior space, said hollow body comprising a first half shell with a first half shell fastening element formed directly on said first half shell and a second half shell with a second half shell fastening element formed directly on said second half shell, said first half shell and said second half shell being fastened together by said first half shell fastening element and said second half shell fastening element in an area of a separating plane to provide a half shell construction, said first half shell having an outwardly projecting collar on which said first half shell fastening element is formed in the area of the separating plane on one side, said first half shell having another outwardly projecting collar on which another first half shell fastening element is formed in the area of the separating plane on another side, said second half shell having an outwardly projecting collar on which said second half shell fastening element is formed in the area of the separating plane on said one side, said second half shell having another outwardly projecting collar on which another second half shell fastening element is formed in the area of the separating plane on said another side, said one side being spaced apart from said another side, said first half shell and said second half shell being in contact with one another and are fastened to one another at the respective said collars, said first half shell fastening element comprising a bracket of said outwardly projecting collar of said first half shell, said second half shell having a collar section acting as a complementary fastening element to said bracket, said collar of said second half shell having an interruption, through which said bracket is passed at right angles to a longitudinal direction of said collar of said second half shell during assembly of said hollow body.

13. A muffler in accordance with claim 12, wherein said collar section has a projection, projecting in a direction of said bracket, at right angles to the separating plane and over which said bracket extends.

14. A muffler in accordance with claim 13, wherein:

said projection is formed by a stamping operation on the respective collar; and said bracket has a locking contour, which is locked with said projection.

15. A muffler for an exhaust system of an internal combustion engine, the muffler comprising:

a muffler housing defining a housing interior space; and an exhaust gas-carrying hollow body arranged in said housing interior space, said hollow body comprising a first half shell with a first half shell fastening element formed directly on said first half shell and a second half shell with a second half shell fastening element formed directly on said second half shell, said first half shell and said second half shell being fastened together by said first half shell fastening element and said second half shell fastening element in an area of a separating plane to provide a half shell construction, said first half shell fastening element comprising an outwardly projecting first half shell collar on one side of said first half shell, said second half shell fastening element comprising an outwardly projecting second half shell collar on one side of said second half shell, said first half shell collar comprising a first half shell collar bracket, said second half shell collar having an interruption, at least a portion of said first half shell collar bracket being passed through said interruption at right angles to a longitudinal direction of said second half shell collar during assembly of said hollow body.

16. A muffler in accordance with claim 15, wherein said first half shell collar bracket has an upper surface, said second half shell collar having a bottom surface, at least a portion of said upper surface being in contact with said bottom surface.

17. A muffler in accordance with claim 15, wherein said first half shell fastening element comprises a first half shell outwardly projecting second collar on another side of said first half shell, said second half shell fastening element comprising a second half shell outwardly projecting second collar on said another side of said second half shell, said one side being spaced apart from said another side, said first half shell and said second half shell being in contact with one another and are fastened to one another at the respective said collars.

* * * * *